US005876266A

United States Patent [19]

Miller et al.

[11] Patent Number: 5,876,266

[45] Date of Patent: Mar. 2, 1999

[54] POLISHING PAD WITH CONTROLLED RELEASE OF DESIRED MICRO-ENCAPSULATED POLISHING AGENTS

[75] Inventors: Matthew Kilpatrick Miller; Clifford Owen Morgan, both of Burlington; Matthew Jeremy Rutten, Milton; Erick G. Walton, South Burlington; Terrance Monte Wright, Williston, all of Vt.

[73] Assignee: International Business Machines Corporation, Armonk, N.Y.

[21] Appl. No.: 892,777

[22] Filed: Jul. 15, 1997

[51] Int. Cl.[6] ..... B24B 1/00

[52] U.S. Cl. ..... 451/36; 438/692; 216/88; 252/79.1

[58] Field of Search ..... 451/526, 548, 451/921; 438/692, 693; 216/88, 89; 156/345 LP; 252/79.1

[56] References Cited

U.S. PATENT DOCUMENTS

| | | |
|---|---|---|
| 2,800,457 | 7/1957 | Green et al. . |
| 2,980,941 | 4/1961 | Miller . |
| 3,619,842 | 11/1971 | Materson . |
| 3,796,669 | 3/1974 | Kiritani et al. . |
| 4,010,292 | 3/1977 | Shackle et al. . |
| 4,025,455 | 5/1977 | Shackle . |
| 4,170,483 | 10/1979 | Shackle et al. . |
| 4,514,461 | 4/1985 | Woo . |
| 4,567,496 | 1/1986 | Ogata et al. . |
| 4,898,734 | 2/1990 | Mathiowitz et al. . |
| 5,073,518 | 12/1991 | Doan et al. . |
| 5,081,051 | 1/1992 | Mattingly et al. . |
| 5,084,419 | 1/1992 | Sakao . |
| 5,234,711 | 8/1993 | Kamen et al. . |
| 5,316,620 | 5/1994 | Hasegawa et al. . |
| 5,330,566 | 7/1994 | Copeland . |

FOREIGN PATENT DOCUMENTS

| | | |
|---|---|---|
| 0 450 656 | 10/1991 | European Pat. Off. . |
| 07-227765 | 8/1995 | Japan . |

*Primary Examiner*—David A. Scherbel
*Attorney, Agent, or Firm*—Howard J. Walter, Jr.

[57] ABSTRACT

A desired reagent is delivered to a workpiece undergoing a chemical mechanical polishing process with a chemical mechanical planarization apparatus. A slurry and polishing pad are provided for the polishing process. Reagent containing microcapsules are also provided, the microcapsules encapsulating a desired reagent. The workpiece is polished with a combination of the slurry, the polishing pad, and the microcapsules, wherein the encapsulated reagents are controllably released during the polishing step via manipulation of a polishing parameter. In one embodiment, the microcapsules are included in the slurry. In an alternate embodiment, the microcapsules are embedded within the polishing pad.

33 Claims, 2 Drawing Sheets

PAD CROSS-SECTION

○ – CAPSULE TYPE A
△ – CALSULE TYPE B
□ – CAPSULE TYPE C

POLISHING PAD WITH CONTROLLED RELEASE OF DESIRED MICRO-ENCAPSULATED POLISHING AGENTS

BACKGROUND OF THE INVENTION

1. Field of the Invention

This invention relates generally to chemical mechanical planarization or polishing tools and, more particularly, to a method and apparatus for chemical mechanical polishing of a semiconductor wafer with a polishing pad having controlled release of desired micro-encapsulated polishing agents.

2. Discussion of the Related Art

In semiconductor device manufacturing of very large scale integrated (VLSI) circuits, extremely small electronic devices are formed in separate dies on a thin, flat semiconductor wafer. In general, various materials which are either conductive, insulating, or semiconducting are utilized in the fabrication of integrated circuitry on semiconductor wafers. These materials are patterned, doped with impurities, or deposited in layers by various processes to form integrated circuits. VLSI integrated circuits include patterned metal layers which are generally covered with dielectric materials, such as oxide, followed by a subsequent metalization, etc. The semiconductor wafers thus contain metalization layers and interlevel dielectrics.

Increasing circuitry miniaturization and a corresponding increase in density has resulted in a high degree of varying topography being created on an outer wafer surface during fabrication. It is often necessary to planarize a wafer surface having varying topography to provide a substantially flat planar surface. One such planarization process known in the art is chemical-mechanical polishing (CMP).

Chemical mechanical polishing or planarization has been widely used in the semiconductor industry for smoothing, polishing or planarizing coating or layers on the surface of semiconductor wafers. This process has been used to achieve the planarization, the controlled reduction in thickness, or even the complete removal of such layers which may include, for example, an oxide on the surface of the semiconductor wafer. Apparatus for such chemical mechanical polishing process is well known and used in the semiconductor industry and is currently commercially available.

Briefly, the chemical mechanical polishing process requires that a workpiece be held, with a desired coated surface face down, on a polishing pad supported on a rotating table, in the presence of an abrasive slurry. A chemical mechanical polishing machine can include a single rotating polishing plate and a smaller diameter rotating wafer carrier to which a wafer (or wafers) is (are) mounted. The wafer carrier is held above the polishing plate, either in a stationary fixed position or oscillating back and forth in a predetermined path in a horizontal plane, while both polishing plate and wafer carrier are rotated about their respective center axes. A slurry, consisting of an abrasive suspension with or without an etching reagent, is fed onto the polishing plate during polishing of the wafer. The slurry, also referred to as a carrier liquid, can be selected to include an etchant for the coating being planarized and for not substantially attacking other materials involved in the process. The slurry is further fed between the polishing plates to polish and flush away the material removed from the semiconductor wafer.

One problem with CMP is that it is difficult to deliver certain fluid media agents to the surface of a substrate during chemical-mechanical polishing. In a typical CMP apparatus, the substrate surface being polished is in intimate contact with an abrasive cloth, also referred to as the polishing "pad", under pressure, and while immersed in an abrasive chemical medium, referred to as the "slurry". In addition, the abrasive cloth and wafer are both in motion. The problem is how to deliver special fluid phase agents to the substrate surface being polished, under these conditions. In many cases, the desired agents are also not compatible with the slurry environment and cannot co-exist in any pH slurry medium. This difficulty may be extended to include such other agents as: reactive chemicals, polar or non-polar fluids, immiscible fluids, or other agents which would not maintain their desired properties or are incompatible if dispersed in a slurry, but which are desirable agents in the polishing process.

Furthermore, in semiconductor wafer polishing, the delivery of fluid polishing agents to the wafer surface is impeded by the juxtaposition of wafer and polishing pad surfaces so as to exclude all but a thin hydrodynamic layer of fluid. As the applied mechanical polishing forces are increased, the polishing rate initially increases, then begins to decline due to the increasing difficulty of delivering reactive polishing fluids to the wafer surface.

It would thus be desirable to provide a method and apparatus for delivering certain fluid media agents to the surface of a substrate during chemical-mechanical polishing.

SUMMARY OF THE INVENTION

An object of the present invention is to provide a method and apparatus for delivering special fluid phase agents to a substrate surface being polished.

In a chemical-mechanical polishing method and apparatus for planarization of a semiconductor wafer, a slurry or polish agent is provided in a microcapsule or microcapsules dispersed in a slurry or polishing pad such that the encapsulated material can be controllably released during a chemical-mechanical polish process via manipulation of CMP process parameters, including an applied force (e.g., down force), pH, time, etc.

According to the present invention, a desired reagent is delivered to a workpiece undergoing a chemical mechanical polishing process with a chemical mechanical planarization apparatus. A slurry and polishing pad are provided for the polishing process. Reagent containing microcapsules are also provided, the microcapsules encapsulating a desired reagent. The workpiece is polished with a combination of the slurry, the polishing pad, and the microcapsules, wherein the encapsulated reagents are controllably released during the polishing step via manipulation of a polishing parameter. In one embodiment, the microcapsules are included in the slurry. In an alternate embodiment, the microcapsules are embedded within the polishing pad.

In addition, the present invention includes a means for controlling a polishing process in response to detection of a detectable condition produced in response to a desired reagent reacting with the polished surface or the polishing effluent during polishing to provide the detectible condition representative of a particular polishing characteristic. For instance, the desired reagent may react with an uncovered underlayer of the workpiece being polished to provide the detectable condition. Alternatively, the desired reagent may react with a temporal effluent produced during the polishing of the workpiece.

BRIEF DESCRIPTION OF THE DRAWINGS

The foregoing and other teachings and advantages of the present invention will become more apparent upon a detailed description of the best mode for carrying out the invention as rendered below. In the description to follow, reference will be made to the accompanying drawings, where like reference numerals are used to identify like parts in the various views and in which.

DETAILED DESCRIPTION OF A PREFERRED EMBODIMENT OF THE INVENTION

Figure 1:
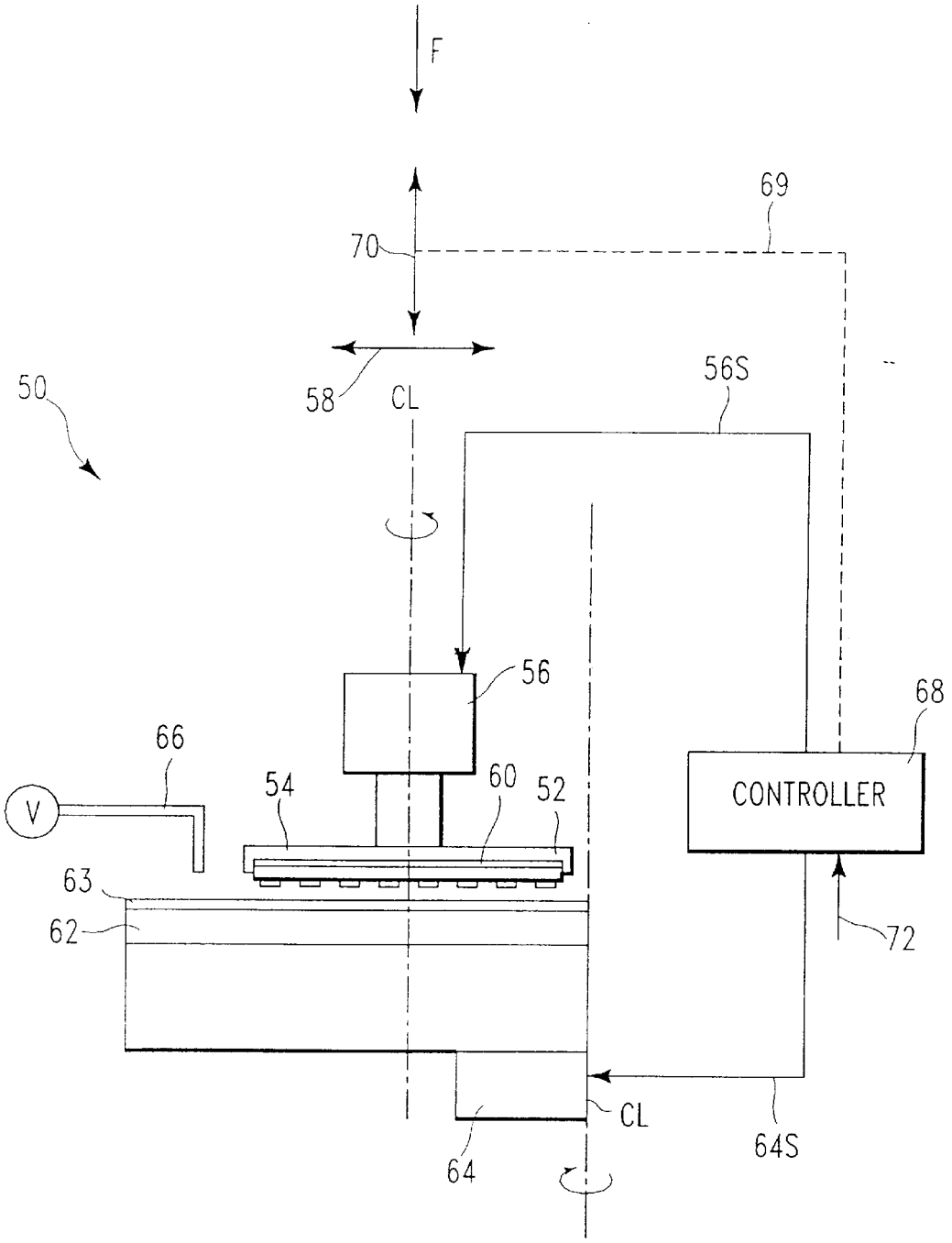
FIG. 1 is a schematic view of a chemical mechanical planarization (CMP) apparatus for use in accordance with the method and apparatus of the present invention.

Referring now to FIG. 1, an apparatus suitable for performing a chemical mechanical planarization (CMP) process in accordance with the present invention is shown and generally designated by numeral 50. The chemical mechanical planarization apparatus 50 includes a wafer carrier 52 for holding a semiconductor wafer 54. The wafer carrier 52 is mounted for rotation as desired by a drive motor 56. In addition, the wafer carrier 52 is mounted for transverse movement as desired, further as indicated by the double headed arrow 58. The wafer carrier 52 may also include a wafer carrier pad 60 formed of a soft material for contacting a backside of the wafer 54. Additionally, wafer carrier 52 may further include a vacuum holding means (not shown) for holding the wafer 54 in the wafer carrier 52 during the chemical mechanical planarization process. The wafer carrier 52 is still further adapted for exerting a downward force F upon the wafer 54. The CMP apparatus 50 further includes a polishing platen 62 mounted for rotation by a drive motor 64. A polishing pad 63 formed in accordance with one embodiment of the present invention, to be discussed in further detail herein below, is mounted to the polishing platen 62. The polishing platen 62 is relatively large in comparison to the wafer 54 so that during the CMP process, the wafer 54 may be moved according to a desired movement across the surface of the polishing pad 63 by the wafer carrier 52. A polishing slurry formed in accordance with another embodiment according to the present invention and discussed further herein below, generally contains an abrasive fluid, such as silica or alumina abrasive particles suspended in either a basic or an acidic solution, and is deposited through a conduit 66 onto the surface of the polishing pad 63.

Referring still to FIG. 1, a controller 68 provides signals via signal lines 56*s*, 64*s* to the wafer carrier drive motor 56 and the platen drive motor 64, respectively, for an appropriate control of the same during a polishing operation, further in accordance with a desired operation and/or planarization sequence. Controller 68 may further include an output control signal for controlling a mechanical arm or other suitable mechanical device (illustrated by the dashed line 69) for performing an intended positioning and/or movement of wafer carrier 52, such as raising and/or lowering the wafer carrier 52 above platen 62 as shown by arrow 70. Other mechanical placements of the wafer carrier 52 can also be controlled as appropriate by controller 68. Controller 68 can further include an input 72, representative, for example, of polishing parameter measured during the polishing process, for controlling a CMP process sequence being carried out upon the CMP apparatus 50 for a particular back-end-of-line VLSI wafer structure. Controller 68 preferably includes any suitable programmable controller device, such as a computer, for performing the intended operations and functions as described herein. Programmable controller devices, computers, associated interface circuitry, and the programming of the same is known in the art and not further discussed herein.

In accordance with the present invention, the present invention includes a means for delivering desirable fluid-phase agents directly to a polishing surface of a substrate under typical polishing conditions. The present invention is especially applicable for those desirable fluid-phase agents which would otherwise be incompatible with the polishing slurry or which would otherwise lose their character or desired properties if dispersed in the slurry.

In a first embodiment, the present invention includes the use of micro-spheroid encapsulants added to a chemical-mechanical polishing slurry. The micro-spheroid encapsulants may be prepared separately from the slurry and added as an inert ingredient to the slurry composition. The micro-encapsulants, further when used in a polishing process, become activated and deliver appropriate doses of desired agents directly to the surface of the polished substrate or wafer during the polishing process.

Micro-spheroid encapsulants are known in various industries. For example, micro-spheroid encapsulants are widely used in the production of carbonless paper production. In addition, a basic description of encapsulants would be to describe them as miniature "water balloons". Micro-spheroid encapsulants, in general, can be formed using solution polymerization reactions as are known in the art. In accordance with the present invention, the micro-spheroid encapsulants contain appropriate doses of desired CMP agents. The micro-spheroid encapsulants include a two part, spheroidal particle. The two part, spheroidal particle includes a fluid center of the particle which contains a desired agent to be delivered to the surface of the polished substrate. The fluid center can include an acid or base, surfactant, polar or nonpolar fluid, chemical reactant, titrant, diluent, buffering agent, solvent, chemical solution or any other fluid phase material. The fluid center is isolated from the ambient by an outer shell, of suitable material, but most normally, a suitable polymerizable material, as is known in the art.

With respect to carbonless paper, encapsulants are applied to a paper surface. Any pressure, such as from a pen-point or pencil causes a rupture of the encapsulant particle walls directly under, and only under, the pen point. A wall rupture results in the release of encapsulant contents, which are typically ink formulations, which stain the paper surface and leave a lasting record of the impression created by the pen or pencil point over the surface of the paper.

In conjunction with the present invention, micro-encapsulant technology is used to prepare micro-spheroid particles using fluids with desirable polishing properties, and to add these encapsulants to a polishing slurry. The outer shell of the micro-spheroids isolates the inner fluid/polishing agent from the slurry. Thus, while distributed in the slurry, the inner fluid maintains its integrity, potency and activity relative to desired polishing properties. As a result, an acid medium may exist in a basic slurry and a non-aqueous fluid may be dispersed in an aqueous medium, etc. without losing its respective important character or desirable polishing effect. During polishing, the micro-spheroids become interposed between the polished substrate surface and the abrasive cloth (i.e., polishing pad). A normal exerted downforce pressure and associated shear forces which are present directly at the polished substrate surface cause the desirable rupture of an encapsulant wall. Upon rupture of an encapsulant wall, the particle contents (special agents) are released, thus making them available directly and immediately to the polished substrate surface during the polishing process.

The present invention is highly useful in the following classes of CMP applications wherein the CMP apparatus includes a micro-encapsulant delivery system according to the present invention. The four classes are distinguished primarily by the type of agent used in the fluid core of the micro-spheroid particles. First among these applications is CMP end-point determination. In the CMP end-point determination application, the special agent in the fluid core of the micro-spheroid is designed to generate a detectible signal when an overlayer film on the substrate surface being polished is removed, thereby exposing an underlayer or substrate film. The special agent may react with the underlayer film, or with the polishing effluent products resulting from exposure/removal of the underlayer or substrate film. The special agent and underlayer are designed as materials which, when combined or reacted, will provide a noticeable and detectable change, such as a color change. For example, the special agent may include a dye precursor which would be activated by a nitrogen compound, such as might be released from the polishing of a silicon nitride underlayer. Alternatively, the special agent might be consumed or converted by the underlayer and a concentration change in polisher effluent could be used to signal an endpoint condition. Any suitable concentration monitor could be used to provide, for example, an effluent concentration measurement signal representative of a desired polishing end-point parameter measured during the polishing process. The effluent concentration signal can then be input to controller 68 via signal input 72 for controlling the CMP polishing end-point.

A second class of applications exist where the special agent in the fluid core includes any compound which alters or augments the polishing process in a desirable manner. Thus, the second class of applications may be thought of as process enhancements. The special agent employed in the core of the micro-encapsulant may include any number of chemicals or materials, such as surfactants, acids or bases, solvating agents, wetting agents, buffers, etc. which when delivered to the polishing surface modify the basic characteristics of the polishing process in a favorable way. Examples of desired affects brought about by these agents could include aiding in slurry removal post polishing, altering the substrate surface potential, enhancing polishing rates, increasing polishing selectivity, decreasing occurrences of undesired scratches, and improving surface wetability. These effects can be effectively modulated through an appropriate manipulation of the micro-encapsulant concentration in the slurry.

The third class of applications may be termed CMP diagnostics. In CMP diagnostics applications, the basic premise is that the release of micro-encapsulant contents (i.e., special agents) is proportional to the amount of slurry which actually makes its way to the critical and active polishing region between the polishing pad and the substrate surface. If the special agent released is easily detectable in the polish effluent, then the temporal special agent concentration could be monitored as a function of process condition. For example, a photomultiplier tube could be used to monitor concentrations of photoluminescent materials, or a spectrophotometer could be used to monitor concentrations of optical agents, or dyes. Thus, the effects of process variables on slurry distribution efficiency could be monitored to optimize or diagnose the particular CMP process. Such information could be advantageously utilized for learning more about the hydrodynamic layer in the active polishing region between the substrate surface and the polishing pad. This knowledge can then be applied to an optimization of process parameters such as polishing rate, uniformity, slurry consumption and distribution methods.

In a fourth class of applications, a polishing pad conditioning can be effected by a special agent released through the rupture of suitable micro-encapsulants in a slurry in accordance with the present invention. In this type of application, the release of micro-encapsulant special agents makes the same available (i.e., renders the special agents available) to the surface of the polishing pad. Rendering the special agents available to the surface of the polishing pad provides any or all of the following benefits. The special agent may condition the pad by preventing slurry and polishing debris from clogging pores of the pad, prevent matting of the pad fibers or prevent decreases in the polishing efficiency of the pad. The interaction of the special agent and the pad may also extend pad life, stabilize polishing rates and/or aid in the dislodging of particles which may cause polishing defects, such as undesirable scratches on the substrate surface. This in-situ chemical conditioning of the pad may also improve polishing productivity by reducing down time associated with polishing pad changes, mitigating a normal decrease in polish rates as a function of polish time, and eliminating or reducing time lost for ex-situ conditioning of the polishing pad through other, typically mechanical, means.

As noted, in general, formulation of a micro-encapsulant particle is known in the art. The microcapsules discussed in conjunction with the present invention can be manufactured through various methods by those skilled in the art of microcapsule manufacture. One method of formation is coacervation such as disclosed in U.S. Pat. No. 2,800,457 (1957) to Green et al. The '457 process involves coating an oil droplet with a liquid wall of gelatin-gum Arabic colloidal material produced by coacervation. The wall is then hardened by treatment with formaldehyde.

A second method of microcapsule manufacture is disclosed in U.S. Pat. No. 3,796,669 (1974) to Kiritani et al. The '669 method involves several steps, including the mixing of polyvalent polyisocyanate as a first wall forming material with a second wall forming material capable of producing a high molecular weight compound by reaction with the polyisocyanate in an oily liquid. The reaction forms a mixture that is emulsified or dispersed in a polar liquid to form a continuous phase. The continuous phase is then reacted with the polyvalent isocyanate and the second wall forming material forming material to form the microcapsule wall from the inside of the oil droplet.

A third and preferred method of microcapsule manufacture is disclosed in U.S. Pat. No. 4,170,483 (1979) to Shackle et al. The preferred method involves the reaction of a wall forming compound, preferably hydroxypropylcellulose, with an oil soluble cross-linking agent. The preferred process includes the steps of preparing an aqueous solution containing a hydroxypropylcellulose wall forming compound containing reactive hydroxyl groups and being characterized by having decreasing solubility with increasing temperature in aqueous solution. The aqueous wall forming compound is prepared while the temperature is maintained at less than 45° C. The viscosity of hydroxypropylcellulose decreases between 45° C. and 52° C., indicating the formation of a solid microcapsule wall. The preferred oil soluble cross-linking agent is a polyfunctional isocyanate.

A preferred microcapsule size for use with the present invention is on the order of 0.01 microns to 1000 microns. A desired payload of the microcapsules is on the order of from 45 to 95 weight percent of the microcapsule. Microcapsules are capable of containing various contents which include, but are not limited to, dry cleaning solvents, mineral spirits, detergents and solutions thereof, lubricants and lubricating oils, metal cleaners, insect repellants, shoe polish, furniture polish, windshield defrosting compositions containing glycerine or other glycols, paint removers and other cleaners, nail polish removers and cosmetics such as taught in U.S. Pat. No. 3,619,842 to Malerson. Mixtures are also possible within the same capsule. Various methods of releasing the contents of a microcapsule include, but are not limited to, exposure to light, temperature, ultrasound, degradation over time, such as hydrolysis, pressure, chemical breakdown, such as salvation. Friction could also be a means of rupturing the microcapsules.

In accordance with the present invention, the possible contents of a microcapsule may include: slurry particles (silica, alumina, etc.), potassium hydroxide (KOH), oxidizing and reducing agents, tetramethyl ammonium hydrate (TMAH), aluminum sulfate, ammonium hydroxide, pH buffers (potassium hydroxide, sodium hydroxide, etc.), amines, igepal, other pH buffers, buffers, surfactants, and other chemicals beneficial to chemical-mechanical planarization. The microcapsules advantageously serve the purpose of delivering the contents to the wafer surface at the pad-wafer interface.

The present invention is thus directed to the inclusion of a micro-encapsulant particle in a polishing slurry for purposes as discussed herein above. In addition, the present invention is directed to a formulation of micro-encapsulant particles with fluidic centers including agents bestowing beneficial properties for polishing substrates of various materials which are used in the manufacture of silicon semiconductor and integrated circuit devices. Still further, the present invention is directed to the release of micro-encapsulant contents through rupture of the micro-encapsulant walls as a result of exposure to normal shearing forces generated during a typical chemical-mechanical polishing process involving a silicon wafer and a polishing pad.

A primary advantage of the present invention is that it provides a superior method for stabilizing incompatible agents in a polishing slurry. In addition, the present invention provides an efficient method for releasing encapsulant agents directly at the surface of the polished substrate during a polishing process to provide beneficial effects or augmentations to the polishing process. In other words, the present invention includes a delivery system and method for providing desirable agents to the surface of polishing substrates, where the agent is otherwise incompatible with the polishing medium.

In accordance with the present invention, a polishing slurry is modified by the addition of fluid-filled micro-spheroid particles (i.e., microcapsules) in the size range of 0.01 to 1000 $\mu$m in diameter. The micro-spheroids included within the polishing slurry contain a fluid center and have an impermeable outer shell. The micro-spheroids further include agents with special properties important to a particular silicon semiconductor wafer polishing process. The micro-spheroids may further include agents contained in a fluid core of the micro-spheroids, wherein the agents are released and made available to the polished substrate surface through the rupture of the membrane wall of the micro-spheroid. In one manner, the micro-encapsulant walls are ruptured using normal and usual forces between the polished surface and the polishing pad, wherein the contents of the fluidic core of the micro-encapsulants are thereby released.

The micro-encapsulants are used to deliver doses of special agents contained in the fluidic cores of the micro-spheroids directly to the surface of the polished substrates during the polishing process. The present invention is especially advantageous in situations where the agents, themselves, are not stable, active or otherwise useful if dispersed into the slurry medium.

The present invention further includes a method of producing a micro-encapsulant having a special agent contained in a fluid core, wherein once the special agent is released, it reacts with the polished substrate, polishing effluent, polishing pad or slurry to do one of the following:

a) impart a special property to the exposed wafer surface, such as change in surface potential, wetability improved selectivity or scratch resistance, aid in the removal of slurry particles;

b) signal a process endpoint;

c) release a dye or other detectable material to aid in a characterization of the polishing process;

d) enhances one or more measurable features of the polishing process, such as, polishing rate or polishing uniformity; and/or, e) modifies the properties of the polishing pad to stabilize the polishing rate, prevent the premature demise of the pad, or otherwise eliminates the need for mechanical pad conditioning process.

Further in accordance with the present invention, a micro-encapsulated special agent is incorporated in a polishing slurry wherein beneficial effects of the special agent are modulated by controlling the concentration of micro-spheroids in the slurry. In addition, the micro-encapsulated special agents are incorporated within the polishing slurry or medium, wherein a micro-encapsulant rupture force may be modulated through a judicious choice of wall materials and wall thicknesses. The specific wall material and wall thickness for a particular micro-encapsulant can be modulated during the micro-spheroid manufacturing process, using any suitable micro-spheroid manufacturing process known in the art, as previously discussed herein.

Figure 2:
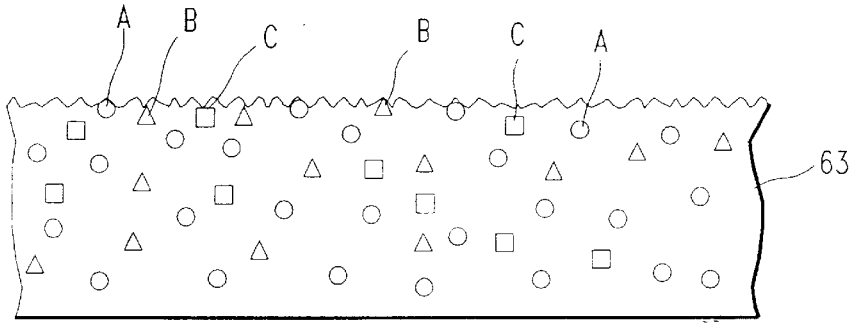
FIG. 2 illustrates a polishing pad having special agent containing micro-capsules incorporated therein in accordance with the present invention.
Figure 3:
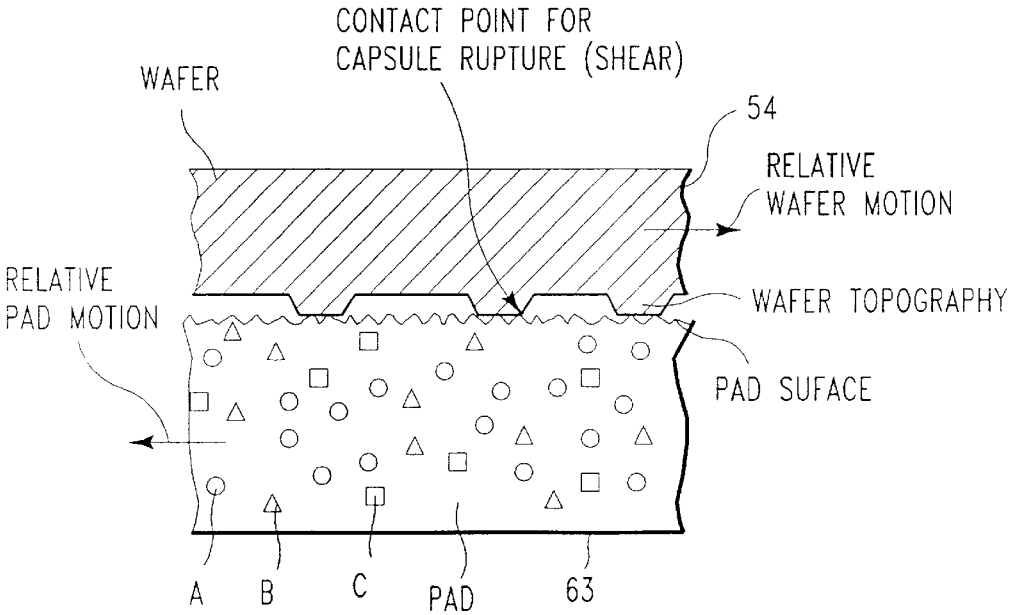
FIG. 3 illustrates a rupturing of an exposed special agent containing microcapsule in accordance with the present invention.

Referring now to FIGS. 2 and 3, in accordance with the present invention, multiple types of micro-encapsulated agents are incorporated into a single polishing medium. That is, the multiple types of micro-encapsulated agents may include a co-existence of reactant microcapsules (designated by 'A'), surfactant microcapsules (designated by 'B'), buffering agent microcapsules (designated by 'C'), etc. in a single polishing medium such as polishing pad 63. The micro-encapsulated agents are incorporated into a polishing medium wherein the micro-encapsulated agents are caused to be ruptured and thereby release their respective contents by any contact method of pad conditioning.

Referring still to FIGS. 2 and 3, in accordance with an alternate embodiment of the present invention, microcapsules of slurry or other beneficial polishing agents are incorporated directly into a polishing pad 63 matrix material. The polishing pad matrix material includes any suitable material, such as, blown polyurethane. Erosion of the polishing pad 63 through either a main polishing action or a normal pad "conditioning" process effectively causes erosion of the pad matrix, first exposing, then eroding microcapsule walls. That is, the microcapsules are exposed, and then the microcapsule walls are eroded. Ultimately, the abrasion action will cause the rupture of the micro-capsules, thus releasing micro-capsule contents only in the region directly in contact with the wafer surface or conditioner surface at the time of rupture. Thus, desired polishing agents are released directly to the surface being polished. Incorporation of the micro-capsules in the polishing pad can mitigate the tendency for increased polishing pressures to decrease polishing rates. In other words, with an increased polishing pressure using the polishing pad having microcapsules incorporated therein, polishing rates are effectively increased. Furthermore, as a result, polishing rates and other desired characteristic polishing results can be advantageously improved (e.g., obtaining an increased polishing rate).

The present invention is advantageously directed to the use of a controlled release of micro-capsule contents in semiconductor wafer polishing materials and applications. In one embodiment, a polishing slurry or agent is incorporated within a micro-capsule or micro-capsules. A polishing pad is then imbedded or impregnated with the microcapsules. Controlled release of the micro-capsule contents is obtained by manipulation of polishing parameters. The polishing parameters include, for example, down force, frictional coefficient, platen rotation speed, wafer carrier rotation speed, etc. as may be appropriate for a particular chemical-mechanical polishing process. The present invention advantageously provides a method for increasing a polishing rate by increasing a force exerted between the wafer carrier and the polishing pad (i.e., a downward force when the wafer being polished is in a generally horizontal orientation).

Still further, in accordance with the embodiment of the present invention in which a polishing slurry or agent is incorporated within a micro-capsule or micro-capsules, and wherein a polishing pad is imbedded or impregnated with the micro-capsules, the present invention permits the polishing of a semiconductor wafer in a vertical orientation. In the vertical orientation, a sideward force is applied between the wafer being polished and the polishing pad. The polishing of a semiconductor wafer in a vertical orientation furthermore allows for a redesign of chemical-mechanical polishing equipment in a generally vertical orientation. As a result of the vertical polishing orientation, valuable semiconductor manufacturing floor space can be more efficiently and optimally used since a vertical orientation will require less square footage of floor space than a horizontally disposed chemical-mechanical polishing apparatus. In other words, the footprint for a vertically oriented CMP apparatus will require less square footage of floor space than the footprint for a horizontally oriented CMP apparatus.

The present invention thus provides several advantages in semiconductor wafer polishing applications. The present invention allows increased polishing rates with increased applied force exerted between the wafer and the polishing pad. The present invention also allows a reduction and/or an elimination of external sources of polishing slurry, outside of the slurry which is contained in the micro-capsules of the polishing pad. The present invention furthermore allows a redesign of conventional polishing equipment to include verticle polishing surfaces not possible with horizontally oriented wet-slurry systems. The present further provides a method for delivery of other polishing agents directly to the wafer or pad or conditioner surface during processing, especially where the agents are incompatible or immiscible with the slurry medium.

In accordance with one aspect of the present invention, slurry waste is advantageously reduced. Reduction of slurry waste occurs in view of the fact that slurry is delivered from the slurry encapsulated pad and is made available directly to the polished surface during a polishing process. Thus the percentage of total slurry which is actually used during the polishing process can be effectively increased, (i.e., more efficiently used) compared with a total supplied amount of slurry. In standard chemical-mechanical polishing applications, as much as ninety-five percent (95%) of the slurry is typically wasted.

The present invention further enables the CMP processing of a semiconductor wafer with a slurry which is made compatible with other polishing agents (e.g., surfactants) using micro-encapsulants. A more effective CMP polishing process is thus produced.

While the invention has been particularly shown and described with reference to specific embodiments thereof, it will be understood by those skilled in the art that various changes in form and detail may be made thereto, and that other embodiments of the present invention beyond embodiments specifically described herein may be made or practice without departing from the spirit and scope of the present invention as limited solely by the appended claims.

What is claimed is:

1. A method for delivering a component to a workpiece undergoing a chemical mechanical polishing process with a chemical mechanical planarization apparatus, said method comprising the steps of:

providing a chemical mechanical planarization apparatus for performing a chemical mechanical polishing process upon a workpiece received thereon;

providing a slurry for the polishing process;

providing a polishing pad;

providing reagent containing microcapsules, the microcapsules encapsulating a desired reagent;

polishing the workpiece with a combination of the slurry, the polishing pad, and the microcapsules; and controllably releasing the encapsulated reagent during the polishing step via manipulation of a polishing parameter.

2. The method of claim 1, wherein said step of providing the reagent containing microcapsules includes providing the reagent containing microcapsules in the slurry.

3. The method of claim 1, wherein said step of providing the reagent containing microcapsules includes providing the reagent containing microcapsules in the polishing pad.

4. The method of claim 1, wherein said step of providing the reagent containing microcapsules includes preparing the reagent containing microcapsules separately from the slurry and adding the reagent containing microcapsules to the slurry.

5. The method of claim 1, wherein said step of providing the reagent containing microcapsules includes preparing the reagent containing microcapsules separately and embedding the reagent containing microcapsules within the polishing pad during a fabrication of the polishing pad.

6. The method of claim 1, wherein said step of providing the reagent containing microcapsules includes providing a single type of desired reagent containing microcapsules during said polishing step.

7. The method of claim 1, wherein said step of providing the reagent containing microcapsules includes providing multiple types of desired reagent containing microcapsules at the same time during said polishing step.

8. The method of claim 1, wherein said step of providing the reagent containing microcapsules includes providing two part spheroidal particles, wherein the two part spheroidal particles each have a fluid center isolated from an ambient by an outer shell, the fluid center including of one of the following selected from the group consisting of an acid, a base, a surfactant, a polar fluid, a non-polar fluid, a chemical reactant, a titrant, a diluent, a buffering agent, a solvent, a chemical solution, and any other fluid phase material.

9. The method of claim 1, wherein said step of controllably releasing the encapsulated reagent during the polishing step includes manipulation of an applied polishing force between the workpiece and the polishing pad.

10. The method of claim 9, further wherein said step of providing the reagent containing microcapsules includes providing the reagent containing microcapsules in the slurry, the slurry and microcapsules being interposed between the polished workpiece surface and the polishing pad, further wherein reagent is made directly and immediately available to the polished surface during said polishing step.

11. The method of claim 1, wherein said step of providing the reagent containing microcapsules includes providing the reagent containing microcapsules in the polishing pad, wherein reagent is made directly and immediately available to the polished surface during said polishing step.

12. The method of claim 1, wherein said step of controllably releasing the encapsulated reagent during the polishing step via manipulation of a polishing parameter includes activating and delivering appropriate doses of desired reagents directly to a surface of the workpiece being polished.

13. The method of claim 1, wherein said step of providing the reagent containing microcapsules includes providing a desired reagent, which during said polishing step, provides a detectible condition representative of a particular polishing characteristic.

14. The method of claim 13, further comprising the step of:

controlling the polishing step in response to a detection of the detectible condition representative of a particular polishing characteristic.

15. The method of claim 13, wherein the desired reagent reacts with an underlayer which is uncovered when an overlayer film on the workpiece surface being polished is removed, the reaction providing a condition useful for detecting a polishing endpoint.

16. The method of claim 13, wherein the desired reagent reacts with polishing effluent resulting from a polishing of a surface of an underlayer which is uncovered when an overlayer film on the workpiece surface being polished is removed, the reaction providing a condition useful for detecting a polishing endpoint.

17. The method of claim 13, wherein the desired reagent is selected for providing a detectible condition useful for a diagnostic application, wherein a temporal release of the reagent from the microcapsules is proportional to an amount of slurry which actually makes its way to a critical and active polishing region between the polishing pad and the workpiece surface.

18. The method of claim 1, wherein said step of providing the reagent containing microcapsules includes providing a reagent which alters and enhances said polishing step in a desirable manner, wherein alteration and enhancement of said polishing step is effectively modulated through an appropriate manipulation of the reagent containing microcapsules.

19. The method of claim 1, wherein said step of providing the reagent containing microcapsules includes providing reagents suitable for use in a desired conditioning of the polishing pad.

20. The method of claim 1, wherein said step of providing the reagent containing microcapsules includes providing a reagent selected from the group consisting of slurry particles including silica and alumina, potassium hydroxide (KOH), oxidizing agent, reducing agent, tetramethyl ammonium hydrate (TMAH), aluminum sulfate, ammonium hydroxide, pH buffers including potassium hydroxide and sodium hydroxide, amines, igepal, pH buffers, buffers, surfactants, and other chemicals beneficial to chemical-mechanical planarization.

21. The method of claim 1, wherein said step of providing the reagent containing microcapsules includes providing a desired reagent which is otherwise incompatible with the slurry.

22. A chemical mechanical planarization apparatus capable of delivering a component to a workpiece undergoing a chemical mechanical polishing process, said apparatus comprising:

a chemical mechanical planarization apparatus for performing a chemical mechanical polishing process upon a workpiece received thereon;

means for providing a slurry for use during the polishing process;

a polishing pad; and means for providing reagent containing microcapsules, the microcapsules encapsulating a desired reagent; and means for manipulating a polishing parameter, wherein the workpiece is polished by a combination of the slurry, the polishing pad, and the microcapsules, and further wherein the encapsulated reagents are controllably released during polishing of the workpiece via manipulation of a polishing parameter.

23. The apparatus of claim 22, wherein said means for providing the reagent containing microcapsules includes the slurry, wherein the slurry contains the reagent containing microcapsules.

24. The apparatus of claim 22, wherein said means for providing the reagent containing microcapsules includes the polishing pad, wherein the polishing pad is imbedded with the reagent containing microcapsules.

25. The apparatus of claim 22, wherein said means for providing the reagent containing microcapsules includes a single type of desired reagent containing microcapsules.

26. The apparatus of claim 22, wherein said means for providing the reagent containing microcapsules includes multiple types of desired reagent containing microcapsules.

27. The apparatus of claim 22, wherein said means for manipulating a polishing parameter includes manipulation of an applied polishing force between the workpiece and the polishing pad.

28. The apparatus of claim 22, wherein said means for providing the reagent containing microcapsules includes providing a desired reagent, which during polishing provides a detectible condition representative of a particular polishing characteristic; said apparatus further comprising means for controlling a polishing of the workpiece in response to a detection of the detectible condition representative of a particular polishing characteristic.

29. The apparatus of claim 28, wherein the desired reagent reacts with an underlayer which is uncovered when an overlayer film on the workpiece surface being polished is removed, and said control means for controlling a polishing end-point in response to a detection of an occurrence of the reaction of the desired reagent with the uncovered underlayer.

30. The apparatus of claim 28, wherein the desired reagent reacts with a polishing effluent resulting from a polishing of a surface of an underlayer which is uncovered when an overlayer film on the workpiece surface being polished is removed, and said control means for controlling a polishing end-point in response to a detection of an occurrence of the reaction of the desired reagent with the polishing effluent.

31. The apparatus of claim 28, wherein the desired reagent is selected for providing a detectible condition useful for a diagnostic application, wherein a temporal release of the reagent from the microcapsules is proportional to an amount of slurry which actually makes its way to a critical and active polishing region between the polishing pad and the workpiece surface.

32. The apparatus of claim 22, wherein said means for providing the reagent containing microcapsules includes providing a reagent which alters and enhances a polishing of the workpiece in a desirable manner, wherein alteration and enhancement of the polishing is effectively modulated through an appropriate manipulation of the reagent containing microcapsules.

33. The apparatus of claim 22, wherein said means for providing the reagent containing microcapsules includes providing reagents suitable for use in a desired conditioning of the polishing pad.

* * * * *